US006241255B1

(12) United States Patent
Fang

(10) Patent No.: US 6,241,255 B1
(45) Date of Patent: Jun. 5, 2001

(54) WATER SEALING TRANSMISSION MECHANISM FOR A MOTION DISPLAY TOY

(76) Inventor: Chien-Tai Fang, PO Box 82-144, Taipei (TW)

( * ) Notice: Subject to any disclaimer, the term of this patent is extended or adjusted under 35 U.S.C. 154(b) by 0 days.

(21) Appl. No.: 09/450,784

(22) Filed: Nov. 30, 1999

(51) Int. Cl.[7] ..... G09F 19/00
(52) U.S. Cl. ..... 277/626; 40/410
(58) Field of Search ..... 277/626, 644; 40/408, 409, 410, 412, 414, 426, 430, 440; 446/267, 134–136

(56) References Cited

U.S. PATENT DOCUMENTS 4,757,986 * 7/1988 Hwang et al. ..... 40/426
4,852,283 * 8/1989 Teng ..... 40/426
4,961,276 * 10/1990 Lin ..... 40/410
5,711,099 * 1/1998 Nesbit et al. ..... 40/406
5,875,577 * 3/1999 Lu ..... 40/411
5,983,541 * 11/1999 Shih ..... 40/410
6,061,937 * 5/2000 Meng ..... 40/409

* cited by examiner

*Primary Examiner*—Anthony Knight
*Assistant Examiner*—Alison K. Pickard
(74) *Attorney, Agent, or Firm*—A & J

(57) ABSTRACT

A water sealing transmission mechanism fastened to the neck of a water container on a base to seal the water container in a watertight condition, and driven by a motor drive in the base to stir up a liquid in the water container, the water sealing transmission mechanism including a rubber packing member fastened to the neck of the water container, a holder mounted in the rubber packing member, the holder having a hollow center post, a transmission shaft mounted in the hollow center post and coupled to the motor drive in the base, a rotary barrel mounted in the receiving chamber in the holder for synchronous rotation with the transmission shaft by means of a magnetic coupling, the rotary barrel having radial blades for stirring up the liquid in the water container, and a carrier fixedly mounted on the holder and spaced above the rotary barrel to hold ornamental means in the liquid in the water container.

6 Claims, 4 Drawing Sheets

WATER SEALING TRANSMISSION MECHANISM FOR A MOTION DISPLAY TOY

BACKGROUND OF THE INVENTION

The present invention relates to water sealing transmission mechanism fastened to the neck of a water container on a base to seal the water container in a watertight condition, and driven by a motor drive in the base to stir up a liquid in the water container.

There is known a motion display toy, which comprises a base holding a motor drive, a water container mounted on the base and holding a liquid and ornamental chips in the liquid, and a transmission mechanism driven by the motor drive to rotate a figure in the liquid inside the water container. In order to keep the water container in a watertight condition, a water-sealing member is fastened to the mouth of the water container and mounted around the output shaft of the transmission mechanism. The water sealing member blocks up the mouth of the water container. This structure of water sealing member is expensive. Further, the water-sealing member wears quickly with use. When the water-sealing member starts to wear, it cannot keep the water container in a perfect watertight condition.

SUMMARY OF THE INVENTION

The present invention has been accomplished to provide water sealing transmission mechanism for a motion display toy, which eliminates the aforesaid drawbacks. According to one aspect of the present invention, the water sealing transmission mechanism is fastened to the neck of a water container on a base to seal the water container in a watertight condition, and driven by a motor drive in the base to stir up a liquid in the water container, the water sealing transmission mechanism comprising a rubber packing member fastened to the neck of the water container, a holder mounted in the rubber packing member, the holder having a hollow center post, a transmission shaft mounted in the hollow center post and coupled to the motor drive in the base, a rotary barrel mounted in the receiving chamber in the holder for synchronous rotation with the transmission shaft, the rotary barrel having radial blades for stirring up the liquid in the water container, and a carrier fixedly mounted on the holder and spaced above the rotary barrel to hold ornamental means in the liquid in the water container. According to another aspect of the present invention, magnets are reversely provided at the transmission shaft and the rotary barrel to produce a magnetic force of attraction between the rotary barrel and the transmission shaft, enabling the rotary barrel to be synchronously rotated with the transmission shaft.

DETAILED DESCRIPTION OF THE PREFERRED EMBODIMENT

Figure 1:
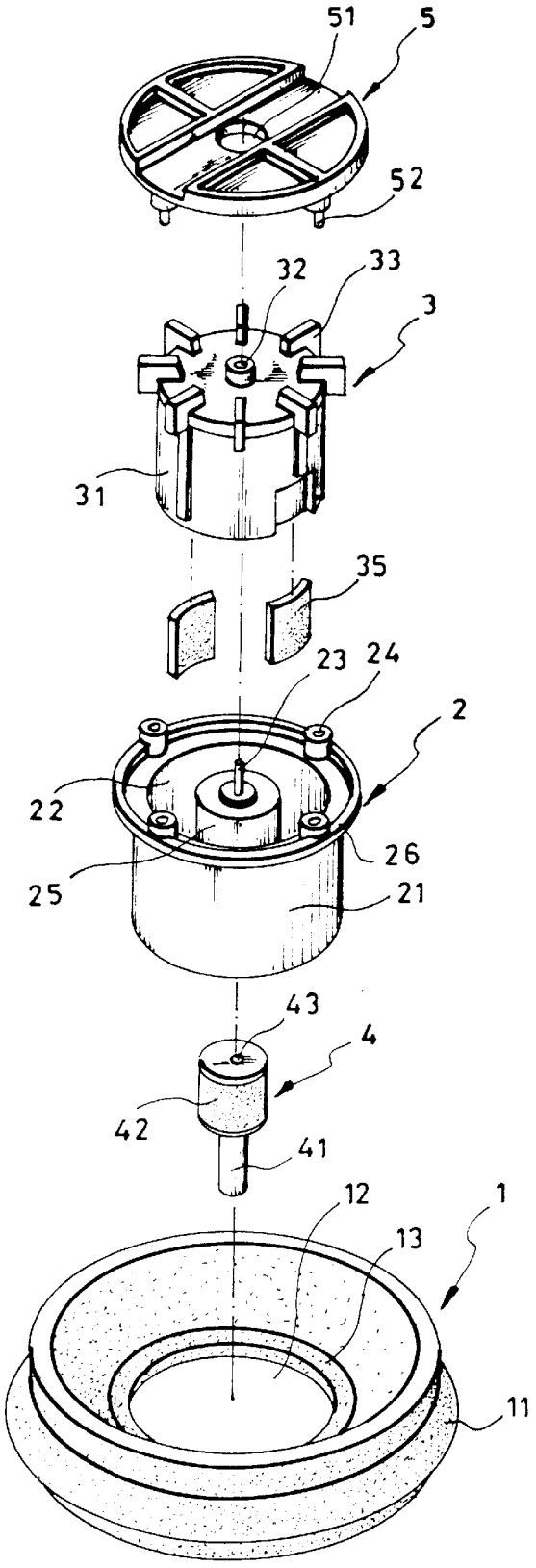
FIG. 1 is an exploded view of water sealing transmission mechanism for a motion display toy according to the present invention.
Figure 2:
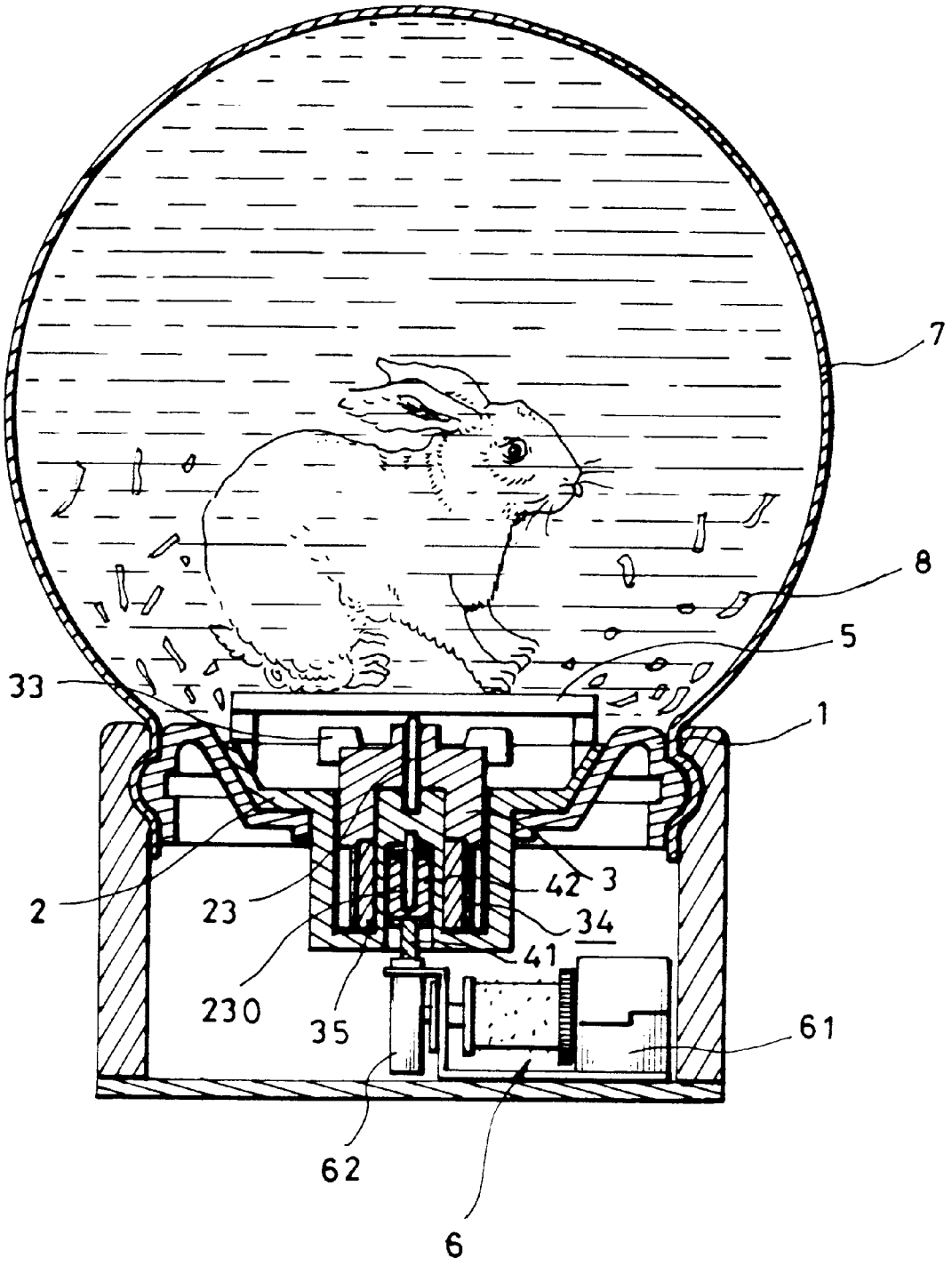
FIG. 2 is a sectional view showing the transmission mechanism installed in a motion display toy according to the present invention.

Referring to FIGS. 1 and 2, water sealing transmission mechanism is shown comprised of a water-sealing packing member 1, a holder 2, a rotary barrel 3, a transmission shaft 4, and a carrier 5.

The water-sealing packing member 1 is a rubber member having a center through hole 12, an inner flange 13 around the center through hole 12, and an outward flange 11 raised around the periphery thereof. The holder 2 comprises a hollow, cylindrical, top-open shell 21 inserted through the center through hole 12 on the water-sealing packing member 1, a rim 26 raised around the top open side of the shell 21 and supported on the inner flange 13 of the water-sealing packing member 1, a hollow center post 25 disposed in the shell 21 at the center, a receiving chamber 22 defined within the shell 21 around the hollow center post 25, an upper axle 23 perpendicularly raised from the center of the flat top side wall of the hollow center post 25, a lower axle 230 suspended in the hollow center post 25 (see FIG. 2), and a plurality of plug holes 24 equiangularly spaced around the topmost edge of the shell 21. The transmission shaft 4 is mounted in the hollow center post 25, comprising a shaft body 41, a center hole 43 axially disposed at the top end of the shaft body 41, and a cylindrical magnet 42 fixedly mounted around the periphery of the top end of the shaft body 41. The rotary barrel 3 is mounted in the receiving chamber 22 and covered over the hollow center post 25, comprising a bottom-open shell 31, a plurality of radial blades 33 equiangularly spaced at the top side of the bottom-open shell 31, a plurality of inside holes 34 on the inside wall of the bottom-open shell 31, a plurality of magnets 35 respectively mounted in the inside holes 34, and a top center hole 32 through the center of the top side wall of the bottom-open shell 31. The polarity of the magnets 35 is arranged reversed to the polarity of the cylindrical magnet 42 at the transmission shaft 4. The carrier 5 is a disk supported on the holder 2 above the rotary barrel 3, comprising a plurality of bottom mounting pins 52 respectively fitted into the plug holes 24 on the holder 2, and a through hole 51 at the center thereof.

The assembly process of the present invention is outlined hereinafter with reference to FIGS. 1 and 2 again. After installation of the magnets 35 in the shell 31, the rotary barrel 3 is mounted in the receiving chamber 22 in the holder 2 and covered over the hollow center post 25, then the bottom mounting pins 52 of the carrier 5 are respectively plugged into the plug holes 24 on the holder 2, and then the transmission shaft 4 is mounted in the hollow center post 25 to couple the center hole 43 of the shaft body 41 to the lower axle 230, enabling a magnetic force of attraction to be produced between the cylindrical magnet 42 at the transmission shaft 4 and the magnets 35 at the rotary barrel 3, and then the cylindrical top-open shell 21 is inserted through the center through hole 12 on the packing member 1, enabling the rim 26 to be supported on the inner flange 13 and adhered thereto by an adhesive. Further, the upper axle 23 extends out of the rotary barrel 3 through the top center hole 32 and suspended in the center hole 51 on the carrier 5 to hold an ornament. After assembly of the transmission mechanism, the periphery outward flange 11 of the packing member 1 are covered with an adhesive and then adhered to the inside wall of the neck of a transparent water container 7 to keep the transparent water container 7 in a watertight condition. The carrier 5 holds an ornament, for example, a toy rabbit inside the transparent water container 7. The transparent water container 7 holds a liquid, and ornamental chips 8 in the liquid. After installation of the water sealing transmission mechanism in the neck of the transparent water container 7 the neck of the transparent water container 7 is mounted in a base, for enabling the shaft body 41 of the transmission shaft 4 to be coupled to the output shaft 62 of a motor drive 6 in the base. The motor drive 6 comprises a DC motor 61 controlled to turn the output shaft 62 through a reduction gear. Starting the DC motor 61 causes the transmission shaft 4 to be rotated with the output shaft 62, thereby causing the rotary barrel 3 to be synchronously rotated with the transmission shaft 4 (due to the effect of magnetic coupling), and therefore the liquid in the transparent water container 7 is stirred up by the radial blades 33 of the rotary barrel 3 and, the ornamental chips 8 are forced to float in the liquid inside the transparent water container 7.

Figure 3:
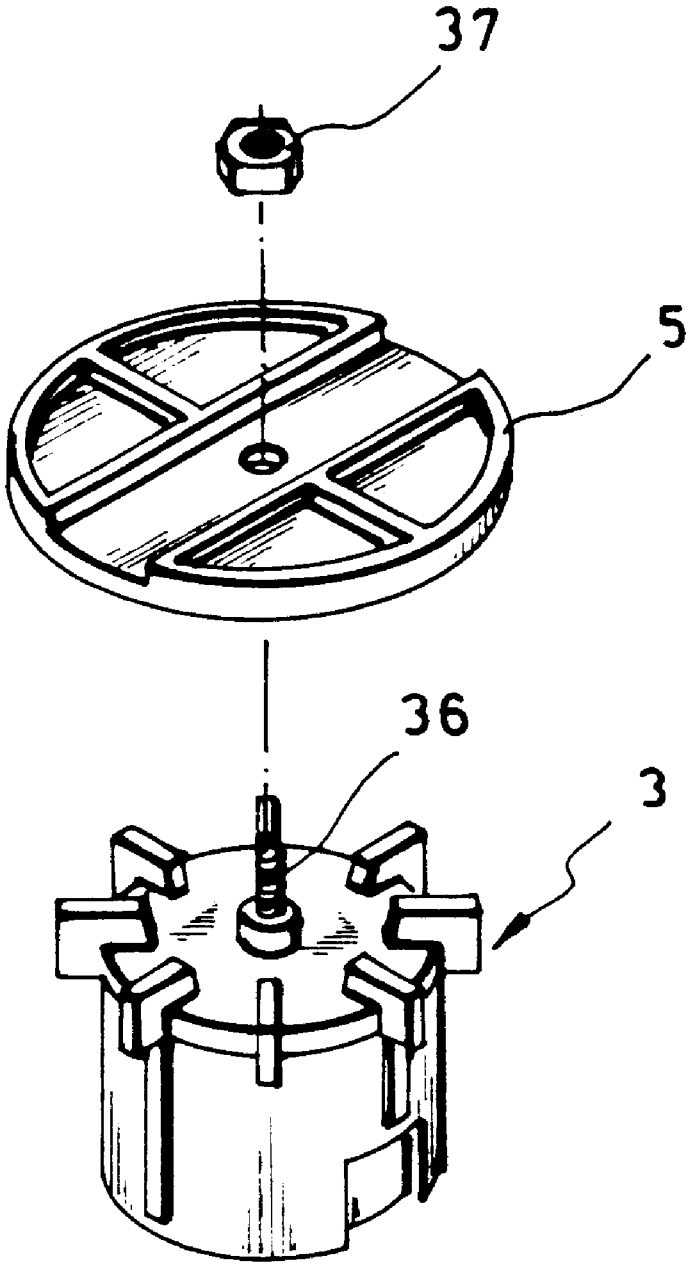
FIG. 3 is an exploded view of an alternate form of the present invention.
Figure 4:
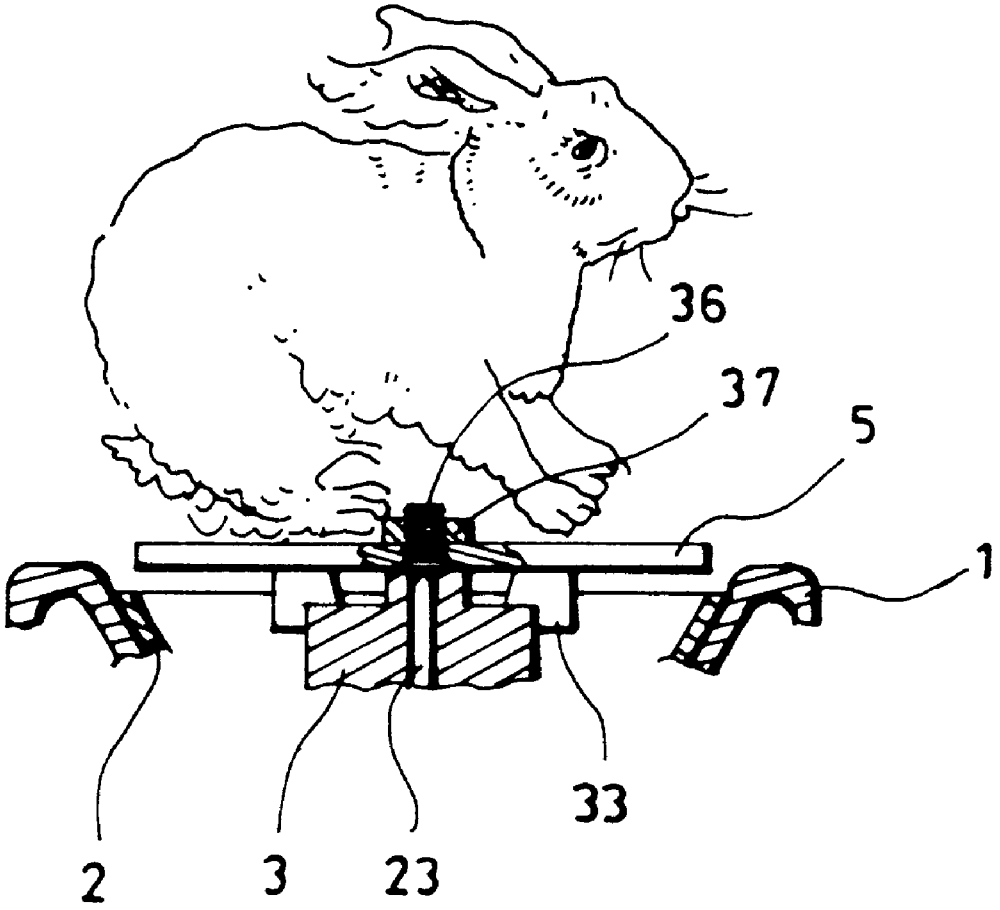
FIG. 4 is a sectional plain view showing the alternate form of the present invention installed.

FIGS. 3 and 4 show an alternate form of the present invention. According to this alternate form, a screw rod 36 is fixedly mounted on the rotary barrel 3 at the top, and the carrier 5 is fixedly fastened to the screw rod 36 by a nut 37 and spaced above the holder 2. When the rotary barrel 3 is rotated, the carrier 5 is synchronously rotated.

It is to be understood that the drawings are designed for purposes of illustration only, and are not intended as a definition of the limits and scope of the invention disclosed.

What the invention claimed is:

1. A water sealing transmission mechanism fastened to the neck of a water container on a base to seal said water container in a watertight condition, and driven by a motor drive in said base to stir up a liquid in said water container, said water sealing transmission mechanism comprising:

a rubber-packing member fastened to the neck of said water container, said rubber packing member comprising a center through hole;

a holder mounted in the center through hole on said rubber packing member to seal the passage of the center through hole, said holder comprising a hollow, cylindrical, top-open shell inserted through the center through hole on said rubber packing member, a hollow center post disposed in said hollow, cylindrical, top-open shell, and a receiving chamber defined within said hollow, cylindrical, top-open shell around said hollow center post;

a transmission shaft mounted in said hollow center post and rotated by the motor drive in said base, said transmission shaft comprising a shaft body coupled to the motor drive in said base, and a cylindrical magnet fixedly mounted around the periphery of said shaft body;

a rotary barrel mounted in the receiving chamber in said holder for synchronous rotation with said transmission shaft, said rotary barrel comprising a bottom-open shell mounted in the receiving chamber in said holder and covered over said hollow center post, a plurality of radial blades equiangularly spaced at a top side of said bottom-open shell, a plurality of inside holes inside said bottom-open shell, and a plurality of magnets respectively mounted in said inside holes and attracted by the cylindrical magnet at said transmission shaft for enabling said rotary barrel to be rotated with said transmission shaft; and a carrier fixedly mounted on said holder and spaced above said rotary barrel to hold ornamental means in the liquid in said water container.

2. The water sealing transmission mechanism of claim 1 wherein said holder comprising an axle suspended in said hollow center post, and said shaft body of said transmission shaft comprises a top center hole coupled to the axle in said hollow center post.

3. The water sealing transmission mechanism of claim 1 wherein said rubber packing member comprises an inner flange raised around the center through hole thereof, and said holder comprises a rim raised around the periphery of said top-open shell and adhered to the inner flange of said rubber packing member.

4. The water sealing transmission mechanism of claim 1 wherein said holder comprises a plurality of plug holes equiangularly spaced on said top-open shell at a top side, and said carrier comprises a plurality of bottom mounting pins respectively fitted into the plug holes on said top-open shell of said holder.

5. The water sealing transmission mechanism of claim 1 wherein said rotary barrel comprises a top screw rod and a lock nut threaded onto said top screw rod, and said carrier is mounted around the top screw rod at said rotary barrel and fixedly secured thereto by said lock nut.

6. A water sealing transmission mechanism fastened to the neck of a water container on a base to seal said water container in a watertight condition, and driven by a motor drive in said base to stir up a liquid in said water container, said water sealing transmission mechanism comprising:

a rubber-packing member fastened to the neck of said water container, said rubber packing member comprising a center through hole;

a holder mounted in the center through hole on said rubber packing member to seal the passage of the center through hole, said holder comprising a hollow, cylindrical, top-open shell inserted through the center through hole on said rubber packing member, a hollow center post disposed in said hollow, cylindrical, top-open shell, and a receiving chamber defined within said hollow, cylindrical, top-open shell around said hollow center post;

a transmission shaft mounted in said hollow center post and rotated by the motor drive in said base, said transmission shaft comprising a shaft body coupled to the motor drive in said base, and a cylindrical magnet fixedly mounted around the periphery of said shaft body;

a rotary barrel mounted in the receiving chamber in said holder for synchronous rotation with said transmission shaft, said rotary barrel comprising a bottom-open shell mounted in the receiving chamber in said holder and covered over said hollow center post, a plurality of radial blades equiangularly spaced at a top side of said bottom-open shell, a plurality of inside holes inside said bottom-open shell, and a plurality of magnets respectively mounted in said inside holes and attracted by the cylindrical magnet at said transmission shaft for enabling said rotary barrel to be rotated with said transmission shaft; and a carrier fixedly mounted on said rotary barrel at topside to hold ornamental means in the liquid in said water container.

* * * * *